US005771542A

United States Patent [19]

Dämmig

[11] Patent Number: 5,771,542

[45] Date of Patent: Jun. 30, 1998

[54] MINIMUM-VALUE SEEKING AUTOLEVELLING OPTIMATION PROCESS

[75] Inventor: Joachim Dämmig, Ingolstadt, Germany

[73] Assignee: Rieter Ingolstadt Spinnereimaschinenbau AG, Ingolstadt, Germany

[21] Appl. No.: 822,339

[22] Filed: Mar. 20, 1997

[30] Foreign Application Priority Data

Apr. 22, 1996 [DE] Germany ..... 196 15 947.4

[51] Int. Cl.[6] ..... D01H 5/32

[52] U.S. Cl. ..... 19/239; 19/236; 364/470.13

[58] Field of Search ..... 19/236, 237, 238, 19/239, 240, 258, 260; 364/470.13, 470.14

[56] References Cited

U.S. PATENT DOCUMENTS 4,819,301 4/1989 Konig et al. ..... 19/240

5,463,556 10/1995 Denz ..... 364/470

5,583,781 12/1996 Denz et al. ..... 364/470.01

*Primary Examiner*—Michael A. Neas

*Attorney, Agent, or Firm*—Dority & Manning

[57] ABSTRACT

A process for direct ascertainment of setting values for point of autolevelling and/or amplification application (R, K) of a draw frame or carder with adjustable drafting of fiber sliver in which the autolevelling of the adjustable draw frame or carder is provided at least with one pilot control (10) in order to change the drafting of the fiber sliver (20) is proposed. The process accelerates optimation but not so that it may produce an inherent restlessness in the autolevelling of the draw frame. This is achieved if a function (a, b) is found through several measured values (CV1, CV2, CV3) of a quality-characterizing magnitude such as CV-value, the minimum of which (am, bm) results in an optimizing parameter such as the point of autolevelling or amplification application (R0, K0) for the autolevelling (10) of the draw frame or carder.

11 Claims, 1 Drawing Sheet

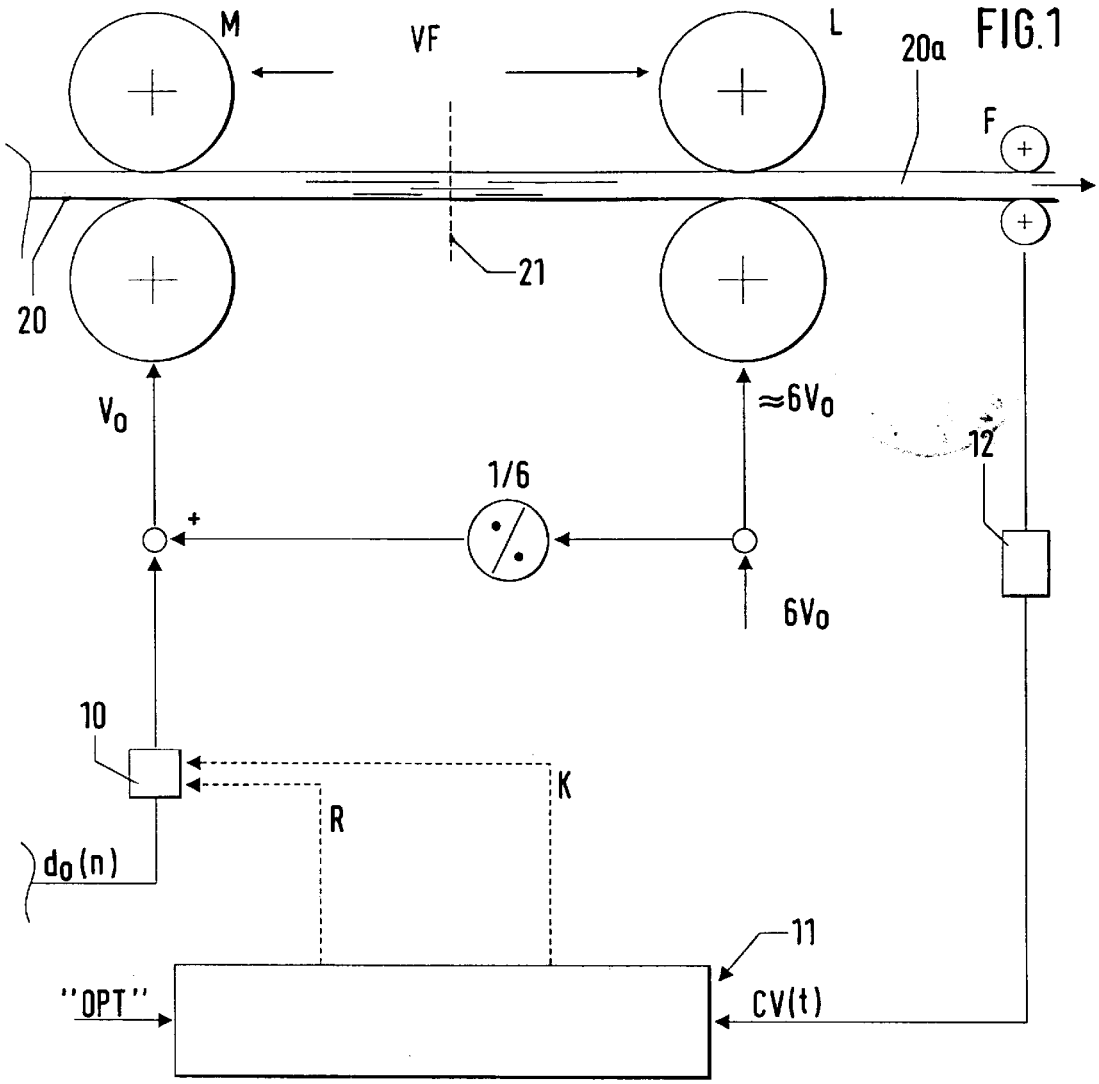
FIG.1
FIG.2A
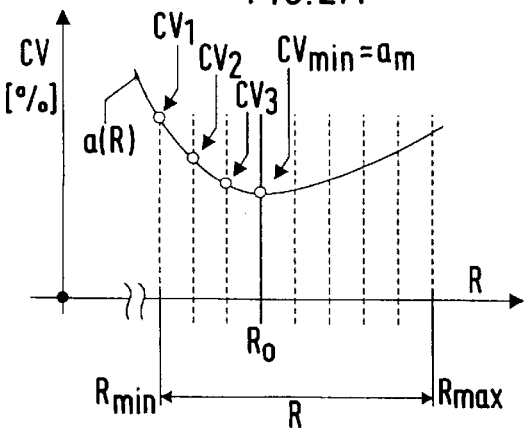
FIG.2B
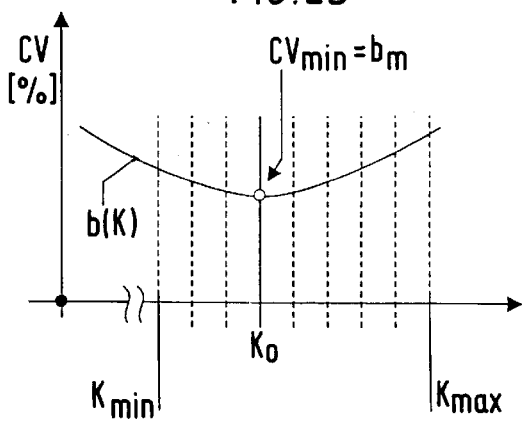

MINIMUM-VALUE SEEKING AUTOLEVELLING OPTIMATION PROCESS

BACKGROUND OF THE INVENTION

The technical area of the invention is the adjustment of an autoleveller in the textile industry which has the task of drafting slivers of textile fiber (fiber fleece) several times and to bring about equalization through drafting.

An example of an autoleveller is described in EP 176 661 B1, with a differentiation made between a short-staple spinning plant and a long-staple spinning plant, whereby within the framework of the long-staple spinning plant the autoleveller is described as working according to the principle of the open control circuit (pilot control). The electronic regulating system RSB 851 of Rieter Ingolstadt AG also operates on the principle of pilot control and has become open to public access through operation since approximately Aug. 1990. In this system the thickness of the incoming fiber slivers (a combined sliver composed of several individual slivers) is measured continuously by means of mechanical scanning (groove roller/scanning roller) and is converted into electrical signals. The measured values are entered into an electronic memory with variable delay. A change in the delay in the RSB 851 causes the drafting change between central roller and delivery roller of the draw frame to occur at the precise moment when the sliver segment with changed thickness previously measured by the scanning roller pair is at the drafting point. The change in drafting therefore occurs in the main drafting zone precisely at the point in time when it is needed. The delay of the measured value makes it possible for the sliver thickness in question in the fiber sliver to be able to cover the distance between the input scanning roller pair and the drafting point. When the sliver thickness has reached the fictitious drafting point in the drafting zone, the corresponding measured value is released by the electronic memory. This distance between point of measurement of the scanning roller pair and drafting point is called the point R of autolevelling application. If the point of autolevelling application has been reached, a setting action takes place on the regulating motor as a function of the measured value.

In the past, the point of regulating application was also called "running time T". Since the scanning system for the obtention of measured values always scans constantly predetermined fiber sliver segments in the RSB 851, independently of the speed of the fiber sliver, the term point of autolevelling application makes sense.

OBJECTS AND SUMMARY OF THE INVENTION

Objects and advantages of the invention will be set forth in the following description, or may be obvious from the invention, or may be learned through practice of the invention.

The starting point and realization of the invention consists here in leaving the on-line adaptation of the autolevelling parameters and to go to finding the parameters of the autolevelling in a pre-operational testing or adjusting run of the draw frame or carder and to leave them substantially unchanged in operation. In the pre-operational adjusting run, a plurality of measured values are found which represent a quality-characterizing magnitude relating the drafted fiber sliver. Based on this plurality of measured values, a function course is determined, the minimum of which corresponds to the value which promises optimal adaptation of the autolevelling to the current fiber sliver. The plurality of measured values recorded and by means of which the function course is determined is measured with a different setting value of the autolevelling, so that an incrementally changing parameter, e.g. the point of autolevelling application of the "electronic memory" can be assigned with each of its increment values to one of the measured values for the definition of the function course to be evaluated.

Based on the minimum-value determination, the optimal value of a parameter can be found according to the invention in the pre-operational test run. This value, in the sense of the present invention, is incorporated into the autolevelling either directly or after passing through a plausibility control or according to suggestions made to a user and upon his confirmation, and is maintained for a long time as a constant in operation. According to the invention, this avoids changing continuously the setting values for autolevelling which had once been found to be good and to risk thereby to effect changes for reason of error magnitudes which are not specific in themselves for the fiber sliver. Good setting values are therefore maintained and not on-line setting values are changed continuously.

As a quality-characterizing magnitude, the CV value can be used which characterizes an amplitude evaluation of the fiber sliver thickness in the fiber sliver delivered in the selective longitudinal area. A microprocessor can be used to determine this CV value for a given sliver length and to accept it in a memory area as a quality-characterizing measured value for a parameter which changes incrementally before the search for minimum value takes place.

Similarly another autolevelling parameter can be optimized before operation, i.e. the amplification K of the pilot control.

One and the other parameter can be optimized one after the other; the not-optimized parameter advantageously does not change its value during the recording of the measured value for the minimum value function.

When a long-term improved quality of the arriving fiber sliver (at the input of the scanning roller pair) is recognized, the interval between measured values for the quality-characterizing magnitude can be lowered. In this manner the minimum is more easily recognized, since too good a quality of the arriving fiber sliver shows an only slightly defined minimum of the CV measured value over the incrementally adjusted autolevelling parameter. If the minimum becomes too flat, it is also possible to use a differentiation or an approximate method in the evaluation.

Long term good quality may be found in the time it takes to fill a can of the hidden sliver.

If one of the parameters is changed almost continuously (incrementally in small steps, but continuously over the long term) in the pre-operational testing or adjusting run, a certain time may pass after any incremental step and the sliver may run through the draw frame or carder with the quality-characterizing magnitude not being measured and without its measured values being taken into account for the function of the determination of the minimum.

The equidistant values for the point of autolevelling application is guided advantageously by the distance between input and scanning roller pair and drafting point; this means that it will be standardized in one length unit.

The proposals according to the invention are faster and at the same time more precise, avoiding the influence of not fiber sliver-specific influences upon the adaptation of the autolevelling. The search for minimum value is a task which is easily carried out algorithmically by a computer. As a result, one or several values is first proposed to the user for the adjustment of autolevelling, and he can then use or discard them.

An important advantage in measuring the sliver before deposit lies in the fact that errors caused by depositing no longer have any influence on the optimation, as was still the case with the ascertainment of a CV value in the textile laboratory or with the ▒ sliver test ▒, where the drafted fiber sliver was taken out after being deposited in the can and was divided up in segments in a sorting of different sliver lengths in order to obtain information through weight on the quality of autolevelling settings.

According to the incremental adjustment of the autolevelling parameters, a solution is furthermore proposed for trouble-free modification of the point of autolevelling application which no longer works with two pointers on one measured-value storage which store new measured values in one point of autolevelling application of several memory values and read out old, delayed measured values. Instead, the number of storage places of the cycle is changed as a function of the running time of autolevelling, so that two pointers at a distance from each other can be dispensed with.

This results in a simplified algorithm and fewer malfunctions when the point of autolevelling application of the pilot control is changed in the control.

According to one embodiment, only one pointer position is used as the write-out point (reading) and write-in point (writing) on one memory. The beginning and the end of the measured-value memory is marked by two limit values which can also take the form of pointers, but which are not incremented in time but whose values change only when the point of autolevelling application of the pilot control is to be changed.

The invention(s) are explained and completed below through several examples of embodiment.

BRIEF DESCRIPTION OF THE DRAWINGS

FIG. 1 is a schematic representation of the drafting zone between a central roller pair M and a delivery roller pair L with a drafting field VF between them, in which the fiber sliver 20 is drafted several times. Autolevelling with pilot control 10 and a control 11, with point of autolevelling application R and amplification K of the drafting pilot control is represented through block diagrams.

FIG. 2*a* is a representation of the minimum-value search for the one parameter (point of autolevelling application).

FIG. 2*b* is a quality function b taking a flat course, with a minimum value $b_{min}$ for the determination of the optimal amplification $K_0$ of autolevelling 10.

DETAILED DESCRIPTION OF THE PREFERRED EMBODIMENTS

Reference will now be made in detail to the presently preferred embodiments of the invention, one or more examples of which are illustrated and described below. Each example is provided by way of explanation of the invention, and not meant as a limitation of the invention. For example, features illustrated or described as part of one embodiment can be used on another embodiment to yield still a further embodiment. It is intended that the application cover such modifications and variations of the invention.

The mechanical and electronic elements are shown schematically in FIG. 1 in order to explain their interaction for control and autolevelling. It is the goal of control and autolevelling to know the drafting point 21 in the drafting field VF in which strong fiber drafting in the arriving fiber sliver 20 takes place as precisely as possible and to ensure that it is influenced by a thickness-measuring signal $d_0(n)$ originating at an input scanning roller pair which precedes the central rollers M and possibly the inlet rollers before them, via a channel or pilot control 10 in such a manner that a change in drafting caused by a change in the speed of the central rollers M occurs precisely when a changed thickness do which was previously measured is located at the drafting point 21. The fiber sliver 20 consists of several individual strands which are brought together by the input-scanning rollers which are not shown here and their combined thickness is ascertained. As a function of the quality of the fiber sliver and the fact whether a fiber sliver is thicker or thinner or possibly torn, the thickness of the sliver 20 changes, and accordingly drafting in the drafting field VF must change. This is obtained through a pilot control 10. This pilot control 10 serves to change the speed $v_0$ of the central rollers M while the speed of the delivery rollers which in the example shown here is approximately six times the delivery speed when six fiber slivers are brought together into one strand at the input remains constant. A suitable channel for the speed v0 over ⅙ of the stationary speed $6.v_0$ of the delivery rollers L can also be integrated into the pilot control 10.

The mechanical portion ends behind the delivery rollers L with calender rollers F to pull off the drafted fiber sliver 20*a*. A can may be used as a deposit. After the output of the delivery roller L and before the deposit, the drafted fiber sliver is measured. In the present example, this measurement concerns the pair of calender rollers by means of which the quality of the fiber sliver 20*a* after drafting can be measured. The magnitude CV % which can be measured directly during the conveying of the fiber sliver (see publication of Rieter Link, volume 2/95, pages 14 and 15) is suitable as a quality-characterizing magnitude. The scanning values (measured values) appearing in length-discrete scanning values are made available as CV value through a calculation over a defined length. The CV value constitutes an evaluation magnitude of a system control 11.

The control 11 receives an optimation command ▒ OPT ▒ and from this produces commands for the incrementation of the point of autolevelling application R and of amplification K.

In an adjustment or testing run, the fiber sliver 20 is drafted between the central rollers M and the delivery rollers L and is conveyed by a depositing device into a can. Separate measurements or inspections of the deposited sliver 20*a* need not be made however, since the CV value measurement is provided with the measuring device 12. At an ▒ OPT ▒ command, the control switches to any first value $R_{min}$, usually an assumed value derived from previously gained experience (e.g. Table) for the point of autolevelling application in a channel of the pilot control 10. The empirical value from the material table can be entered with a keyboard. However, it is also possible for a memory integrated into control 11 to supply the empirical value from a stored table. Following the passage of a given quantity of sliver which should be just long enough so that a clear CV value can be calculated from it, a CV value is retained. This CV value is designated $CV_1$ in FIG. 2*a*. This measured value from the measuring device 12 is written into a memory zone of control 11. The point of autolevelling application R of the pilot control which was first set is then modified by at least one incrementation magnitude. The sliver 20 then runs again for a given period of time, until the corresponding $CV_2$ value is stored by control 11 in the same memory area.

Similarly, another incrementation of the point of autolevelling application and another measurement of a $CV_3$ value takes place until a reasonable number (approx. 5, 10 or 15 measured values) are at disposal, comprised between a minimum point of autolevelling application $R_{min}$ and a maximum point of autolevelling application $R_{max}$. The function a(R) which forms thereby in the memory area of control 11 and the function a(R) which is formed with it can be searched for a minimum by evaluation methods. In the case of the function drawn in FIG. 2*a*, this minimum can be assumed to be at $R_0$ where the minimum $CV_{min}$ lies. The position which is recognized as the minimum $Cv_{min}$ of the function a, also designated $a_m$, defines the best setting for the point of autolevelling application R of the pilot control 10, with at first an amplification factor K which is at first maintained constant in the channel for the thickness measuring signal $d_0(n)$.

Once a minimum $a_m$ has been found for the setting of the point of autolevelling application of the electronic memory of the pilot control 10, this point of autolevelling application—possibly also after passing through a plausibility control and confirmed by the operator—can be incorporated into the electronic memory of the pilot control 10. The same testing and adjusting run is then carried out to find a function b(k) shown in FIG. 2*b*, whereby this quality function depends on the changing amplification K. In practice it has been shown that this function takes as a rule a flatter course and does not show as clearly defined a minimum $CV_{min}=b_m$. If the evaluation of the pure measured value $C_{vi}$, I-1 . . . n, where n should be comprised between 5 and 10, does not lead to a usable result for $K_0$ as the best value for the amplification and $R_0$ as the best value for the point of autolevelling application, one or the other curve can also be differentiated by the program control in control 11 in order to clarify the minimum. The result of the differentiation is that not a minimum, but a zero passage of the differentiated function must be found, as is possible with measuring functions a(R) and b(K) taking a close to steady course.

When the best values have been found for $R_0$ and $K_0$ in accordance with the above procedure, these values can be incorporated directly into the pilot control 10 before starting the actual production operation of the draw frame. The found values R and K can however also be first proposed to the operator who incorporates them upon explicit wish into the pilot control 10 by actuating an entering element (key).

To ensure that no erroneous value is set for R and K for the actual production operation due to random influences, a plausibility control may be provided which uses a predefined admissibility window between two limit values for a given quality of fiber sliver 20 in order to check the best value found through minimum search and to find out whether it lies in this window.

The point of autolevelling application parameter which is thus set for the production operation and for the amplification of the pilot control 10 are no longer changed during the production operation but rather remain constant. At long time intervals, or if it suspected that these parameters are no longer the best setting for the draw-frame, a new search for minimum value can be carried out in a setting run of the draw frame. To do this, production must be interrupted briefly.

On the basis of a few numerical values as example, it is possible to measure which precise setting is possible for the point of autolevelling application R with the minimum-value-seeking optimation. If a distance of approximately one meter (1 m) between the point of measurement and the drafting point is assumed, the point of autolevelling application R corresponds to the distance needed by a sliver segment from point of measurement to point of drafting. If the optimation is immediately adapted to the distances, the changes of the point of autolevelling application may be 3 mm, between to measured values $CV_1$ and $CV_2$. The distances to the other measured values can be identical in order to obtain distance-constant scanning. Only when the measurement of the CV value is effected with a sufficiently large number of individual measurements is a secured value for the storage as quality-measured value of function a(R) and b(K) available.

With this method in the setting run the quality function a(R) and b(K) can thereby be determined in a continuous manner without stopping and setting the sliver. The method is thus extremely fast, operator-friendly and very quiet for the actual production operation with the best adapted parameters.

The hardware or software realization in the control 11 to change the point of autolevelling application R of the pilot control is realized with variable memory length. Measured values originating from the thickness measurement $d_0(n)$ are continuously entered into these memory cells located in the memory. They represent the momentary values of the sliver thickness going currently through the input scanner roller pair.

The memory in which the above-mentioned length-discrete measured values are stored has a variable length or (shown in a circle) an inflating and reducing circumference, if the same distance between memory values are assumed on the circumference of the circle. In the real memory area—linear and one after the other—the measured values are entered via indication of a pointer value in the memory and are read out at that same location. The delay between two reading and writing cycles for a memory cell corresponds to the distance covered from the point of measuring to the drafting point between the central rollers and the delivery rollers (point of autolevelling application). The beginning and the end of the memory are therefore located at the same point.

The old value which now indicates the thickness which is located at the drafting point is first read at the described writing location, and the new Value is then stored as thickness value which has just been measured with the time-discrete value $d_0(n)$ through the scanning roller pair. The old value corresponds to the preceding cycle, the new value is that of the current cycle.

The memory lengths thus do not change continuously. Nor are two pointers required, of which one defines the point of writing and the other pointer defines the point of reading.

It should be appreciated by those skilled in the art that various modifications and variations can be made in the present invention without departing from the scope and spirit of the invention. It is intended that such modifications and variations be included in the application as come within the scope of the appended claims and their equivalents.

I claim:

1. A process for controlling the drafting operation of a textile machine drafting equipment, wherein at least one of the parameters of point of autoleveling application and autoleveling amplification are optimized and used as setting values in an operational phase of the drafting equipment, said process comprising the steps of:

in a pre-operational phase of the drafting equipment, processing fiber sliver through the drafting equipment and measuring a quality characterizing value of the fiber sliver as a function of a selected one of the parameters of point of autoleveling application and autoleveling amplification to be optimized;

determining from said processing and measuring step an optimized setting value of the selected parameter that generates a minimum value of the quality characterizing value; and utilizing the optimized setting value as a substantially constant optimized parameter in a following operational phase of the drafting equipment.

2. The process as in claim 1, comprising holding the value of the non-selected parameter of point of autoleveling application or autoleveling amplification relatively constant during said processing, measuring, and determining steps.

3. The process as in claim 2, further comprising finding an optimized value for the non-selected parameter according to said processing, measuring, and determining steps while holding the selected parameter substantially constant at its respective optimized setting value, and using both optimized values in said utilizing step.

4. The process as in claim 3, further comprising repeating said processing, measuring, and determining steps for each of said parameters until the optimized setting values remain substantially constant in said repeated steps.

5. The process as in claim 1, wherein prior to said utilizing step the optimized setting value undergoes a plausibility check.

6. The process as in claim 3, wherein the optimized setting value for selected parameter is entered directly into a control system for the drafting equipment before said finding an optimized setting value for the non-selected parameter.

7. The process as in claim 1, wherein the quality characterizing value of the fiber sliver is a CV value.

8. The process as in claim 7, wherein the CV value is measured at a point between delivery rollers of the drafting equipment and a place of deposit for the fiber sliver.

9. The process as in claim 1, wherein said measuring step comprises measuring a plurality of discrete values of the ciliated characterizing value, and further comprising decreasing the interval between said measuring so as to better define the minimum value thereof.

10. A process for controlling a point of autoleveling drafting in a textile machine drafting equipment, wherein a fiber sliver thickness value is detected at a sensing point and stored in a memory until the sensed portion of the fiber sliver is in a drafting zone of the textile machine drafting equipment, said process comprising:

for a fiber sliver being introduced into the drafting equipment, detecting sliver thickness values at a sensing point;

cyclically writing the sliver thickness values into storage locations of a memory, the memory having a plurality of storage locations wherein the number of said storage locations made available for storing the sliver thickness values is variable;

cyclically reading the sliver thickness values out of their respective storage locations for utilization by the drafting equipment once the sensed portion of the fiber sliver has reached the drafting zone;

said writing and reading steps taking place so that a new sliver thickness value is written into a storage location from which a sliver thickness value has just been read out so that there is no offset between storage locations from which sliver thickness values are written into and read out of the memory; and wherein storage time between said writing and reading of individual sliver thickness values is adjusted by varying the number of storage locations in the memory available for said cyclic writing and reading steps.

11. The process as in claim 10, wherein said writing and reading steps take place with a single pointer in the memory.

* * * * *